United States Patent [19]

Peter et al.

[11] 4,352,254

[45] Oct. 5, 1982

[54] CARTRIDGE PACKAGE FOR RAPID LOADING OF A MAGAZINE OR CLIP FOR AUTOMATIC AND SEMIAUTOMATIC WEAPONS

[76] Inventors: Kurt Peter, Donaustrasse 101/12, A-2344 Maria Enzersdorf/Südstadt; Gerhard Muck, Peter Jordanstrasse 159, A-1180 Wien, both of Austria

[21] Appl. No.: 153,828

[22] Filed: May 27, 1980

[51] Int. Cl.[3] ..... F42B 39/06

[52] U.S. Cl. ..... 42/88

[58] Field of Search ..... 42/88, 87

[56] References Cited

U.S. PATENT DOCUMENTS

| | | | |
|---|---|---|---|
| 578,931 | 3/1897 | Johnson | 42/88 |
| 2,894,350 | 7/1959 | Janson | 42/87 |
| 3,143,820 | 8/1964 | Lucianettl et al. | 42/88 |
| 3,789,531 | 2/1974 | Kersten | 42/87 |

FOREIGN PATENT DOCUMENTS

| | | |
|---|---|---|
| 1204973 | 11/1965 | Fed. Rep. of Germany . |
| 2107864 | 10/1971 | Fed. Rep. of Germany . |
| 2150458 | 7/1973 | Fed. Rep. of Germany . |

*Primary Examiner*—Charles T. Jordan

*Attorney, Agent, or Firm*—Montague & Ross

[57] ABSTRACT

A package for cartridges for rapid reloading of bolt-type magazine or clip for a weapon especially for automatic and semiautomatic military weapons, comprises a generally U-shaped frame whose shanks form inwardly open channels receiving opposite ends of the cartridges or rounds. The mouth of the package is formed with a substantially funnel-shaped seat adapted to surmount the mouth of the magazine or clip so that the stack of cartridge can be pressed from its side opposite the mouth into the magazine, e.g. by the insertion of fingers through windows defined between the shanks. The seat is asymmetrical with respect to the median plane through the package with side of the seat being formed with openings opposite the aprons which define the funnel shape.

5 Claims, 4 Drawing Figures

FIG.1
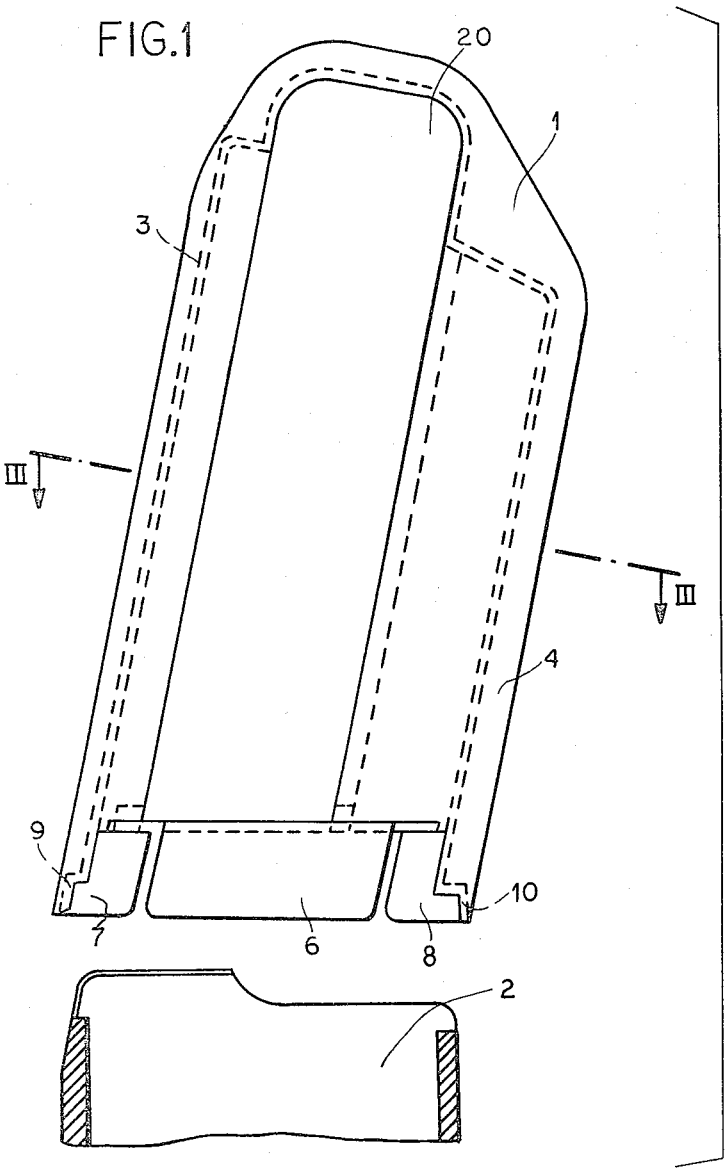
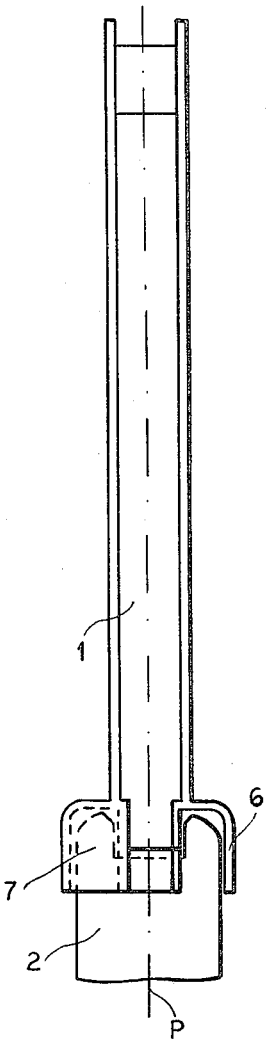
FIG.2
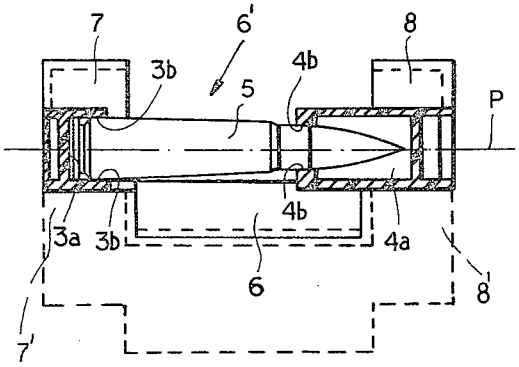
FIG.3
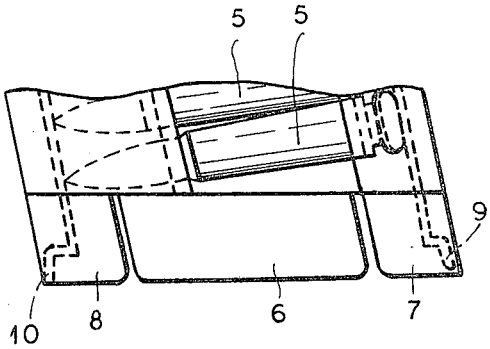
FIG.4

CARTRIDGE PACKAGE FOR RAPID LOADING OF A MAGAZINE OR CLIP FOR AUTOMATIC AND SEMIAUTOMATIC WEAPONS

FIELD OF THE INVENTION

Our present invention relates to a cartridge package for the rapid loading of elongated magazines or clips for use in automatic and semiautomatic weapons, especially military weapons such as machine pistols, automatic and semiautomatic rifles and machine guns.

BACKGROUND OF THE INVENTION

In automatic and semiautomatic weapons, especially military weapons of the type mentioned, a magazine can be used for automatic feed of successive cartridges to a chamber of the weapon, the ejection and feed of each round being effected by gas power or recoil energy. For this purpose, the magazine may be a flat elongated bolt-shaped structure having a mouth which can be clipped into a socket on the weapon stock or body and is provided with a spring for pressing the cartridges toward the weapon chamber. Generally such magazines or clips can be factory filled and in most instances are refillable by the users.

In conventional refilling operations, a succession of cartridges are fed one by one into the mouth and pressed downwardly by the fingers of the reloader until the magazine or clip is fully loaded.

There have also been proposed cartridge packages which contain a number of cartridges which can be fitted onto the mouth of the magazine or clip so that the entire stack of cartridges can be pressed into the magazine in a single simple operation.

One such package described in German patent document (Offenlegungsschrift) DE-OS No. 21 07 864 permits a reliable loading of a magazine or clip, even under environmentally difficult conditions, e.g. in the dark, and where the user may be under psychic strain, e.g. under battlefield conditions, providing a package which has channels guiding the opposite ends of the stack of cartridges into the magazine or clip and a funnel-shaped mouth facilitating application of the package to the mouth of the magazine or clip. Pressure upon the stack at its side remote from the seat on the magazine or clip entrains the cartridges into the latter.

In this construction, however, the seat is so formed that, although the funnel configuration snugly receives the magazine mouth, it is difficult to stack the packages. In other words, when a number of such packages is piled up, the enlarged mouth portions interfere with one another and prevent an orderly stack from being maintained.

More specifically, the funnel-shaped mouth at one end of the package bulged substantially symmetrically around the entire circumference of the mouth so that a stack of the packages with the funnel-shaped seats upon one another caused the stack to tilt and be unstable. If the funnel-shaped members were not stacked upon one another, the pile of packages had a stepped configuration and was again unstable. Practical use of the packages, which generally were stored and utilized in large number, was limited.

OBJECT OF THE INVENTION

It is the object of the present invention to provide an improved reloading package of the type described which, however, can be readily and neatly stacked in a pile with a high degree of stability.

SUMMARY OF THE INVENTION

This object and others which will become apparent hereinafter are attained, in accordance with the present invention, in a U-shaped or C-shaped frame structure forming a reloading package and in which the shanks of the U form guide channels for opposite ends of the cartridges and the opposite faces of the package are open to form windows through which the stack of cartridges can be engaged and forced into the magazine.

The funnel-shaped mouth or seat formed at the open end of the frame is interrupted peripherally, i.e. is not symmetrical about the median plane through the package which is parallel to the plane of the stack, whereby interruptions in the periphery of the funnel-shaped mouth are disposed opposite portions of this mouth in the form of aprons so that the aprons of one package can fit into the openings or interruptions of an adjoining package when a plurality of packages are stacked.

In other words, each mouth or funnel is provided with a plurality of mouth-forming sections separated by spaces and the spaces on one side of the median plane are disposed opposite sections on the other side of the median plane.

The funnel-forming sections only extend over 50% of the periphery of the magazine received in the mouth or seat and where structure is provided on one side, it is omitted on the other, thereby facilitating stacking in a simple manner.

The present invention also affords a saving in material.

BRIEF DESCRIPTION OF THE DRAWING

The above and other objects, features and advantages of the present invention will become readily apparent from the following description, reference being made to the accompanying drawing in which:

FIG. 1 is a side-elevational view of a package according to the present invention with the cartridges omitted and as juxtaposed with the upper end of the magazine shown in cross section;

FIG. 2 is a front elevational view of the package of FIG. 1 shown mounted upon the magazine;

FIG. 3 is a section taken along line III—III of FIG. 1 with a cartridge shown in place; and FIG. 4 is a fragmentary view of the mouth portion of the package of FIG. 2 seem from the opposite side and shown to be provided with the cartridges.

SPECIFIC DESCRIPTION

The cartridge package 1 which is adapted to be placed over the mouth of a magazine or clip 2 for an automatic or semi-automatic weapon is a downwardly open U-shaped frame whose shanks 3 and 4 define channels 3*a* and 4*a*, respectively, in which opposite ends of the cartridges 5 are guided and in which the cartridges can be stacked in side-by-side relationship (FIG. 4).

As illustrated in the drawing, the lateral edges 3*b* or 4*b* of these channels slidably grip the flanks of the cartridges so that the latter are laterally guided and a longitudinal displacement is not possible as long as the spacing between the shanks 3, 4 corresponds to the length of the cartridges. The cartridges thus do not tend to shift within the package but can be displaced by the insertion of one or more fingers in the windows 20 between the shanks to drive the cartridges into the magazine.

In FIG. 2 the magazine 2 is shown to have its open end received within the mouth of the package, the mouth being formed by members 6 through 8 partially surrounding the open end of the magazine around its periphery.

The lower open end of the frame has its shanks 3, 4 bridged on side-by-side wall 6 bent first outwardly and then downwardly (FIG. 2). On the opposite side of the longitudinal median plane P, the outer sections 7, 8, which are also bent outwardly and then downwardly, are spaced apart so that the shanks 3 and 4 are not interconnected.

The side wall 6 and the outer sections 7, 8 define with short stepped end wall sections 9, 10 of the shanks 3, 4, a frustoconical seat adapted to receive and rest upon the open end of the magazine.

From FIGS. 2 and 3 it will be apparent that the sections 3 through 8 are disposed asymmetrically with respect to the median plane P and for each section on one side, there is a gap in the mouth periphery on the opposite side. Gaps 6', 7' and 8' can, for example, be discerned. From FIG. 3 is will be apparent that the section 6 of an upper pack can be received in the opening 6' of the one shown and that the sections 7 and 8 of the lower pack can be received in the cutouts 7', 8' so that a multiplicity of these packages can be stacked with no spacing between in a neat stable pile (see the dot-dash showing of the next underlying package).

The outer sections 7, 8 can be so formed that they have no end wall sections inasmuch as lateral shifting of the cartridges is precluded by the end walls 9, 10 of the shanks 3, 4.

In the embodiment shown, the end walls 9, 10 have a configuration facilitating an effective feed upon the magazine and are not essential.

The package can be formed from a synthetic resin material and can either be discardable for one-way use or refillable as desired.

We claim:

1. A reloading package for the rapid feed of a stack of cartridges into a magazine of an automatic or semiautomatic weapon, said package comprising a generally U-shaped frame formed with an open end and having a pair of mutually parallel shanks having inwardly open guide channels for guiding opposite ends of the cartridges of said stack toward said open end, said shanks being spaced apart to define a window affording access to said stack whereby said cartridges can be fed into said magazine, said open end of said frame being formed with a funnel-shaped mouth adapted to receive an end of said magazine, said mouth being asymmetrical with respect to a median plane through said frame parallel to the plane thereof whereby the mouths of a plurality of similar packages can interfit upon a stacking thereof.

2. The package defined in claim 1 wherein the mouth at said open end of said frame is defined by a wall section bridging said shanks on one side of said plane and a pair of additional sections on the opposite side of said plane spaced from one another across a gap separating said shanks.

3. The package defined in claim 2 wherein said additional sections are spaced apart by a gap dimensioned to receive the wall section of an identical package stacked upon the first-mentioned package.

4. The package defined in claim 1 containing a stack of cartridges, said channels being provided with guide edges laterally emplacing said cartridges.

5. The package defined in claim 4 wherein said frame and said sections are formed unitarily of synthetic resin material.

* * * * *